US005335502A

United States Patent [19]

Roberts, Jr. et al.

[11] Patent Number: 5,335,502

[45] Date of Patent: Aug. 9, 1994

[54] ARCHED COMBUSTOR

[75] Inventors: Hubert S. Roberts, Jr.; Adrian M. Ablett, both of Cincinnati; Ambrose A. Hauser, Wyoming, all of Ohio

[73] Assignee: General Electric Company, Cincinnati, Ohio

[21] Appl. No.: 982,359

[22] Filed: Nov. 27, 1992

Related U.S. Application Data

[62] Division of Ser. No. 942,473, Sep. 9, 1992.

[51] Int. Cl.[5] ..... F02C 3/14

[52] U.S. Cl. ..... 60/752

[58] Field of Search ..... 60/39.32, 39.37, 752, 60/755, 757; 220/609

[56] References Cited

U.S. PATENT DOCUMENTS 2,576,046 11/1951 Scarth ..... 60/755
3,657,882 4/1972 Hugoson ..... 60/39.31
4,109,459 8/1978 Ekstedt et al. ..... 60/757
4,177,637 12/1979 Pask ..... 60/39.36

OTHER PUBLICATIONS

Lefebvre, Arthur H. *Gas Turbine Combustion,* New York, N.Y.; McGraw-Hill, 1983, pp. 13, 22, 23, 25.

*Primary Examiner*—Richard A. Bertsch
*Assistant Examiner*—Timothy S. Thorpe
*Attorney, Agent, or Firm*—Charles L. Moore, Jr.; Jerome C. Squillaro

[57] ABSTRACT

A gas turbine engine combustor includes radially spaced outer and inner liners disposed coaxially about an engine longitudinal centerline axis with each liner having forward and aft ends. An annular dome is fixedly joined to the forward ends of the outer and inner liners. The outer liner has a substantially uniform thickness and is arcuate in a longitudinal plane from the forward to aft ends for providing buckling resistance of the outer liner.

10 Claims, 4 Drawing Sheets

ARCHED COMBUSTOR

This application is a division of application Ser. No. 07/942,473, filed Sep. 9, 1992.

TECHNICAL FIELD

The present invention relates generally to gas turbine engine combustors, and, more specifically, to a combustor including an outer liner having improved buckling resistance.

BACKGROUND ART

A gas turbine engine combustor is a pressure vessel provided with pressurized airflow from a compressor disposed upstream thereof. The compressed airflow is channeled to carburetors disposed in a dome end of the combustor wherein it is mixed with fuel for generating a fuel/air mixture for combustion in the combustor. A portion of the compressed airflow is also provided around the liner walls through which it is conventionally channeled for providing cooling and dilution air into the combustor. The pressure of the compressed airflow external of the combustor is greater than the pressure of the combustion gases inside the combustor which results in external gas pressure loads being applied to the combustor liners which must be suitably accommodated for providing acceptable buckling resistance margin in the combustor.

Combustor liners are typically made from conventional high temperature sheet metal or relatively thin castings and therefore inherently have relatively low buckling resistance capability. Accordingly, conventional stiffening rings are typically provided at least on the combustor outer liner which is subject to the buckling gas pressure loads for providing acceptable buckling resistance margin. The stiffening rings may comprise a plurality of axially spaced circumferentially extending rings for providing increased stiffness, or circumferentially spaced, axially extending stiffening flanges. Such stiffening rings may be used in addition to relatively flexible conventional cooling rings or nuggets which provide film cooling air along the inner surface of the liners for providing acceptable cooling thereof. In some conventional embodiments, the cooling nuggets may be relatively large for providing by themselves adequate stiffness for accommodating gas pressure buckling loads applied to the outer liner.

Conventional cooling nuggets are typically in the form of annular rings extending around the circumference of the combustor and form an integral part of the liners. The nuggets have a generally u-shaped longitudinal profile for defining an annular plenum for receiving a portion of the compressed airflow from outside the combustion liner. The nuggets also include an aft facing annular slot for directing the cooling air as an annular film along the inner surface of downstream portions of the liner for providing effective film cooling thereof.

It is desirable to eliminate such stiffening rings for reducing complexity, weight, and cost of the combustor. It is also desirable to eliminate the cooling rings for reducing complexity, weight, and most significantly, the amount of cooling air required for cooling the combustor liners. The efficiency of the combustor, and therefore of the gas turbine engine, can be increased if less of the compressed airflow is used for cooling the combustor and is instead used for mixing with fuel and undergoing combustion. However, without the use of such stiffening rings and cooling rings, the stiffness of the combustor liners would be substantially reduced thus leading to undesirable buckling thereof unless other means for accommodating the gas pressure buckling loads are used.

OBJECTS OF THE INVENTION

Accordingly, one object of the present invention is to provide a new and improved combustor for a gas turbine engine.

Another object of the present invention is to provide a combustor having improved buckling resistance capability.

Another object of the present invention is to provide a combustor having an improved radially outer liner which is relatively simple and effective for accommodating gas pressure buckling loads.

Another object of the present invention is to provide a combustor outer liner which does not require stiffening rings or cooling nuggets for providing acceptable buckling resistance capability and acceptable cooling effectiveness of the liner.

DISCLOSURE OF INVENTION

A gas turbine engine combustor includes radially spaced outer and inner liners disposed coaxially about an engine longitudinal centerline axis with each liner having forward and aft ends. An annular dome is fixedly joined to the forward ends of the outer and inner liners. The outer liner has a substantially uniform thickness and is arcuate in a longitudinal plane from the forward to aft ends for providing buckling resistance of the outer liner.

BRIEF DESCRIPTION OF DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

MODE(S) FOR CARRYING OUT THE INVENTION

Figure 1:
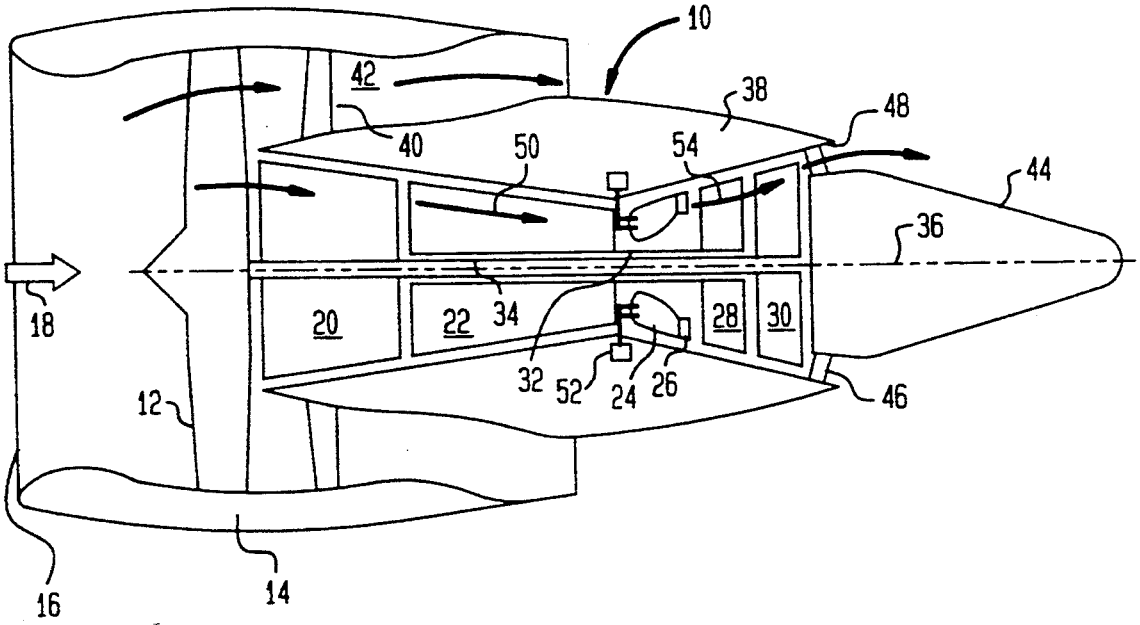
FIG. 1 is a longitudinal sectional schematic view of a high bypass turbofan gas turbine engine including a combustor in accordance with the present invention.

Illustrated in FIG. 1 is a longitudinal centerline schematic view of a high bypass turbofan engine 10. The engine 10 includes a conventional fan 12 disposed inside a fan cowl 14 having an inlet 16 for receiving ambient airflow 18. Disposed downstream of the fan 12 is a conventional low pressure compressor (LPC) 20 followed in serial flow communication by a conventional high pressure compressor (HPC) 22, a combustor 24 in accordance with one embodiment of the present invention, a conventional high pressure turbine nozzle 26, a conventional high pressure turbine (HPT) 28 and a conventional low pressure turbine (LPT) 30. The HPT 28 is conventionally fixedly connected to the HPC 22 by an HP shaft 32, and the LPT 30 is conventionally connected to the LPC 20 by a conventional LP shaft 34. The LP shaft 34 is also conventionally fixedly connected to the fan 12. The engine 10 is symmetrical about a longitudinal centerline axis 36 disposed coaxially with the HP and LP shaft 32 and 34.

The fan cowl 14 is conventionally fixedly attached to and spaced from an outer casing 38 by a plurality of circumferentially spaced conventional struts 40 defining therebetween a conventional annular fan bypass duct 42. The outer casing 38 surrounds the engine 10 from the LPC 20 to the LPT 30. A conventional exhaust cone 44 is spaced radially inwardly from the casing 38 downstream of the LPT 30 and is fixedly connected thereto by a plurality of conventional circumferentially spaced frame struts 46 to define an annular core outlet 48 of the engine 10.

During operation, the airflow 18 is compressed in turn by the LPC 20 and HPC 22 and is then provided as pressurized compressed airflow 50 to the combustor 24. Conventional fuel injection means 52 provide fuel to the combustor 24 which is mixed with the compressed airflow 50 and undergoes combustion in the combustor 24 for generating combustion discharge gases 54. The gases 54 flow in turn through the HPT 28 and the LPT 30 wherein energy is extracted for rotating the HP and LP shafts 32 and 34 for driving the HPC 22, and the LPC 20 and fan 12, respectively.

Figure 2:
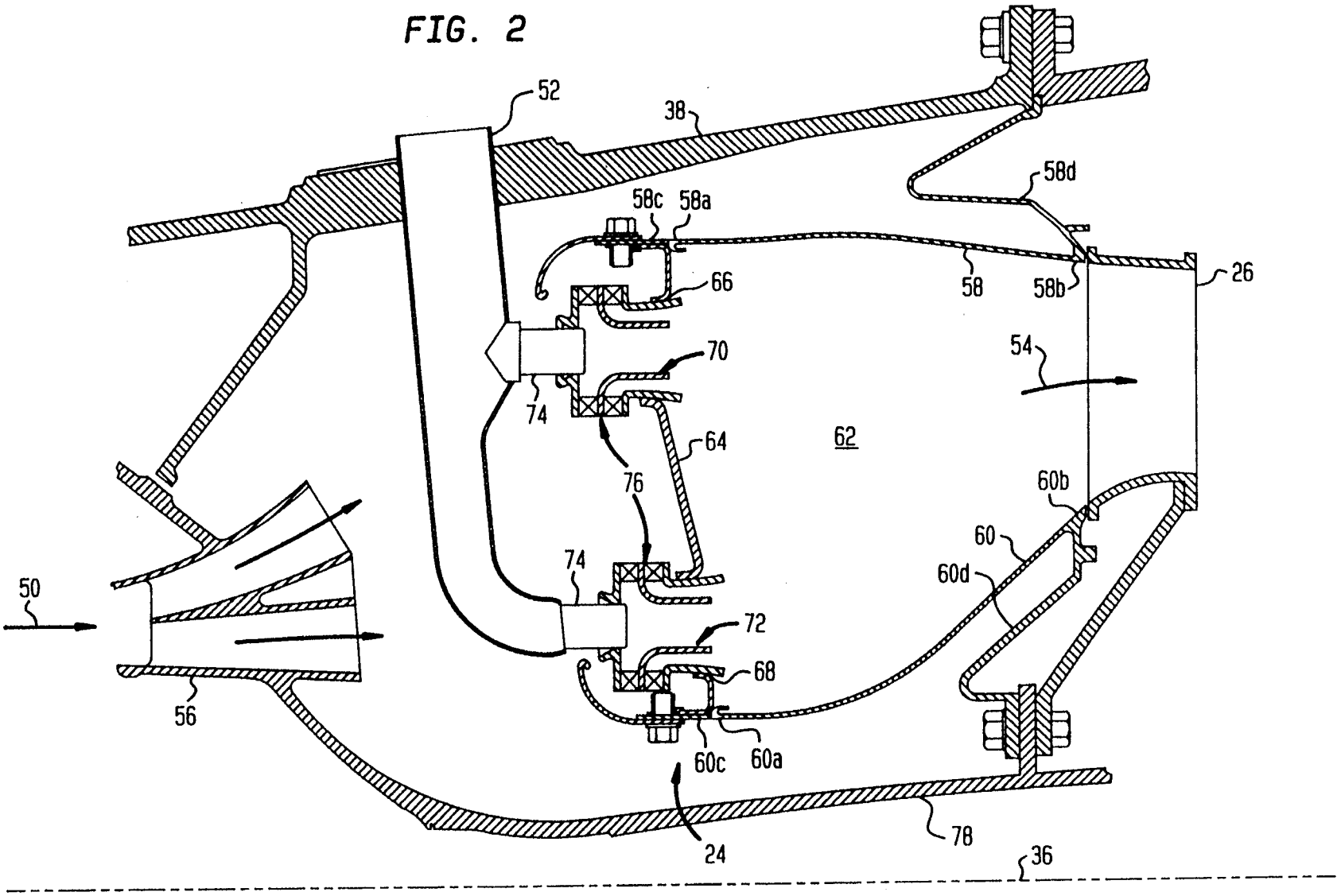
FIG. 2 is an enlarged longitudinal sectional view of a portion of the combustor illustrated in FIG. 1 in accordance with one embodiment of the present invention.

Illustrated in FIG. 2 is a longitudinal sectional view of the combustor 24 in accordance with a preferred and exemplary embodiment. Disposed upstream of the combustor 24 is a conventional diffuser 56 which conventionally reduces the velocity of the compressed airflow 50 received from the HPC 22 for increasing its pressure and channelling the compressed airflow 50 to the combustor 24. The combustor 24 includes an axial centerline axis, which is the same as the centerline axis 36 of the engine 10, and annular outer and inner liners 58 and 60, respectively, disposed coaxially about the centerline axis 36.

The outer liner 58 is annular in radial planes extending perpendicularly to the centerline axis 36 and is disposed radially outwardly of the inner liner 60. The inner liner 60 is also annular in radial planes disposed perpendicularly to the centerline axis 36 and is disposed radially inwardly of the outer liner 58. The outer and inner liners 58 and 60 are spaced radially from each other to define an annular combustion zone 62 therebetween in which the compressed airflow 50 and fuel from the fuel injection means 52 undergoes combustion for generating the discharge gases 54.

The outer liner 58 includes an upstream, forward end **58*a* and a downstream, aft end 58*b*, and similarly, the inner liner 60 includes an upstream, forward end 60*a* and a downstream, aft end 60*b*, between which forward and aft ends the liners 58 and 60 define the combustion zone 62. An annular dome 64, which in the preferred embodiment is a double annular dome, is conventionally fixedly joined to the forward ends 58*a* and 60*a*** of the outer and inner liners by a plurality of circumferentially spaced bolts, for example.

More specifically, the double dome 64 includes a plurality of circumferentially spaced radially outer apertures 66 and a plurality of circumferentially spaced radially inner apertures 68 for receiving two radially spaced rows of circumferentially spaced first carburetors 70 and second carburetors 72. The first and second carburetors 70 and 72 each comprises a conventional fuel injector 74 which provides fuel to a conventional counter-rotational air swirler for providing fuel/air mixtures into the combustion zone 62 for combustion.

The outer liner 58 includes an integral forward axial flange **58*c* extending from the forward end 58*a* which is bolted to the dome 64, and similarly, the inner liner 60 includes a forward axial flange 60*c* extending integrally from the forward end 60*a* and fixedly connected to the dome 64. The outer liner aft end 58*b* is formed integral with a radially extending generally U-shaped annular aft radial flange 58*d* which is conventionally fixedly connected to the stationary casing 38 by being clamped between two portions thereof, for example. The inner liner aft end 60*b* is similarly formed integrally with a radially inwardly extending aft radial flange 60*d* which is conventionally fixedly connected to a stationary inner casing 78**, by bolts for example.

Accordingly, the combustor 24 is supported solely at the outer and inner aft ends **58*b* and 60*b* by the radial flanges 58*d* and 60*d* to the stationary casings 38 and 78, respectively. The radial flanges 58*d* and 60*d* provide a substantially rigid support in the axial direction as well as in the radial direction while allowing for thermal expansion and contraction of the outer and inner liners in the radial direction during operation. The forward ends 58*a* and 60*a* and the dome 64 of the combustor 24 are allowed to float freely in space by the aft mounts of the combustor 24. The fuel injectors 74 are conventionally axially slidably disposed in the swirlers 76 for accommodating differential axial thermal expansion and contraction and are also allowed to slide radially relative to the swirlers 76 for accommodating differential radial thermal expansion and contraction. Accordingly, the forward end of the combustor 24 is free to expand and contract both radially and axially without restraint from the fuel injectors 74 and the outer and inner casings 38 and 78, respectively, and relative to the aft ends 58*b* and 60*b***.

Figure 3:
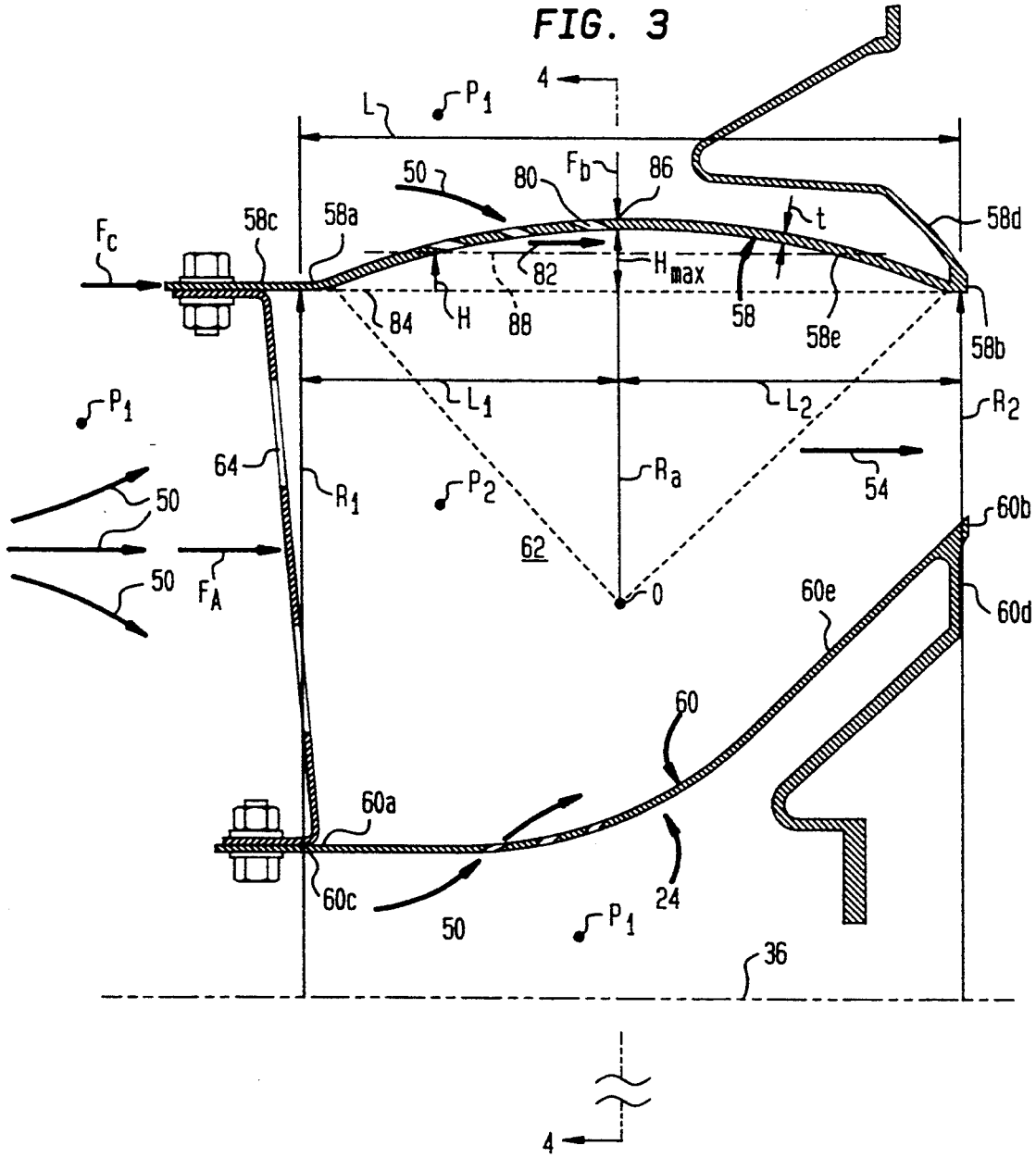
FIG. 3 is an enlarged longitudinal sectional view of the combustor illustrated in FIG. 2.

FIG. 3 illustrates in more particularity the combustor 24 in accordance with a preferred embodiment of the present invention with the carburetors 70 and 72 being removed from the dome 64 for clarity. The compressed airflow 50 is provided to the combustor 24 at a first pressure $P_1$ which is greater than the pressure $P_2$ of the combustion gases found in the combustion zone 62. Since the inner liner 60 is subject to a pressure load of $P_1$ minus $P_2$ in a radially outward direction, it is not subject to buckling from such pressure loading. However, the outer liner 58 is subject to a positive differential pressure $P_1$ minus $P_2$ which generates a generally uniform buckling load in a radially inward direction which tends to buckle the outer liner 58. The uniform buckling load or force is represented schematically by the single arrow $F_b$.

Conventional cooling nuggets are not utilized in either the outer liner 58 or the inner liner 60 in accordance with one feature of the present invention but instead, a plurality of circumferentially and axially spaced rearwardly inclined cooling air holes 80 are used and extend through the liners 58 and 60 for providing a cooling air film 82 along the inner surfaces **58*e* and 60*e* of the outer and inner liners, respectively, for cooling the liners. Only a few of the cooling air holes 80 are shown in FIG. 3, it being understood that the holes 80** are provided from the forward to aft ends of both liners 58 and 60 and around the full circumference thereof for providing acceptable cooling of the liners 58 and 60.

Furthermore, conventional stiffening rings are not employed for the outer liner 58 and therefore neither stiffening rings nor cooling nuggets are available for providing buckling resistance capability of the outer liner 58. Instead, the outer liner 58 is configured to have a substantially uniform thickness t from the forward end 58*a* to the aft end 58*b* for the entire extent of the outer liner 58 extending both axially therebetween and circumferentially relative to the centerline axis 36. Furthermore, the outer liner 58 is also arcuate, and preferably is convex outwardly relative to the centerline axis 36 in an axial, or longitudinal plane, one of which is illustrated in FIG. 3, from the forward end 58*a* to the aft end 58*b* for providing a predetermined buckling resistance capability of the outer liner 58. By configuring the outer liner 58 as a convex arch having substantially uniform thickness, buckling resistance capability is provided solely thereby without the need for conventional stiffening rings, flanges, or cooling nuggets for providing required buckling resistance capability during operation.

More specifically, in the preferred embodiment illustrated in FIG. 3, the outer liner forward end 58*a* is fixedly connected by the axial flange 58*c* to the dome 64 which is in turn fixedly connected to the inner liner forward end 60*c* for defining a pressure vessel bounding the combustion zone 62. The dome 64 is an annular plate which extends in the radial direction, and therefore is substantially rigid. The outer liner aft end 58*b* is fixedly connected to the outer casing 38 by the substantially rigid radial flange 58*d*, and, similarly, the aft end 60*b* is rigidly supported by the radial flange 60*d*. Accordingly, the outer liner 58 which defines the outer boundary of the combustion zone 62 is radially fixedly supported in two spaced radial planes at both its forward end 58*a* and its aft end 58*b*.

Furthermore, the outer liner 58 has a straight chord 84 which extends from the forward end 58*a* to the aft end 58*b* and the curvature of the outer liner 58 may be defined relative thereto. More specifically, the outer liner 58 is defined as having an arch height H measured from the chord 84 perpendicularly outwardly therefrom to the outer liner 58. The height H increases from a zero value at the forward end 58*a* to a maximum value $H_{max}$ at a first length $L_1$, measured parallel to the chord 84, near the center of the chord 84. The arch height H then decreases over a second length $L_2$, measured parallel to the chord 84, to a zero value at the aft end 58*b*. The outer liner 58 has an apex 86 of maximum arch height $H_{max}$ which is preferably disposed substantially equidistantly between the forward and aft ends 58*a* and 58*b* with $L_1$ being preferably equal to $L_2$.

The single arch configuration of the outer liner 58 may be predetermineally sized for providing an effective amount of buckling resistance capability for the outer liner 58. In the preferred embodiment, the outer liner 58 has a substantially constant radius of curvature $R_a$ in the longitudinal plane from the forward end 58*a* to the aft end 58*b*. The origin O of the radius of curvature $R_a$ is disposed radially inwardly of the outer liner 58 so that the outer liner 58 is convex outwardly relative to the centerline axis 36. In this way, the buckling loads $F_b$ acting over the outer surface of the outer liner 58 tend to compress the outer liner 58 between its forward and aft ends 58*a* and 58*b* generating compressire stresses therein which are effective for resisting buckling of the outer liner 58.

By arching the outer liner 58, the moment of inertia of the outer liner 58 is increased by providing portions of the outer liner 58 at relatively large distances from a neutral axis 88 about which the outer liner 58 tends to bend in the circumferential direction.

Figure 4:
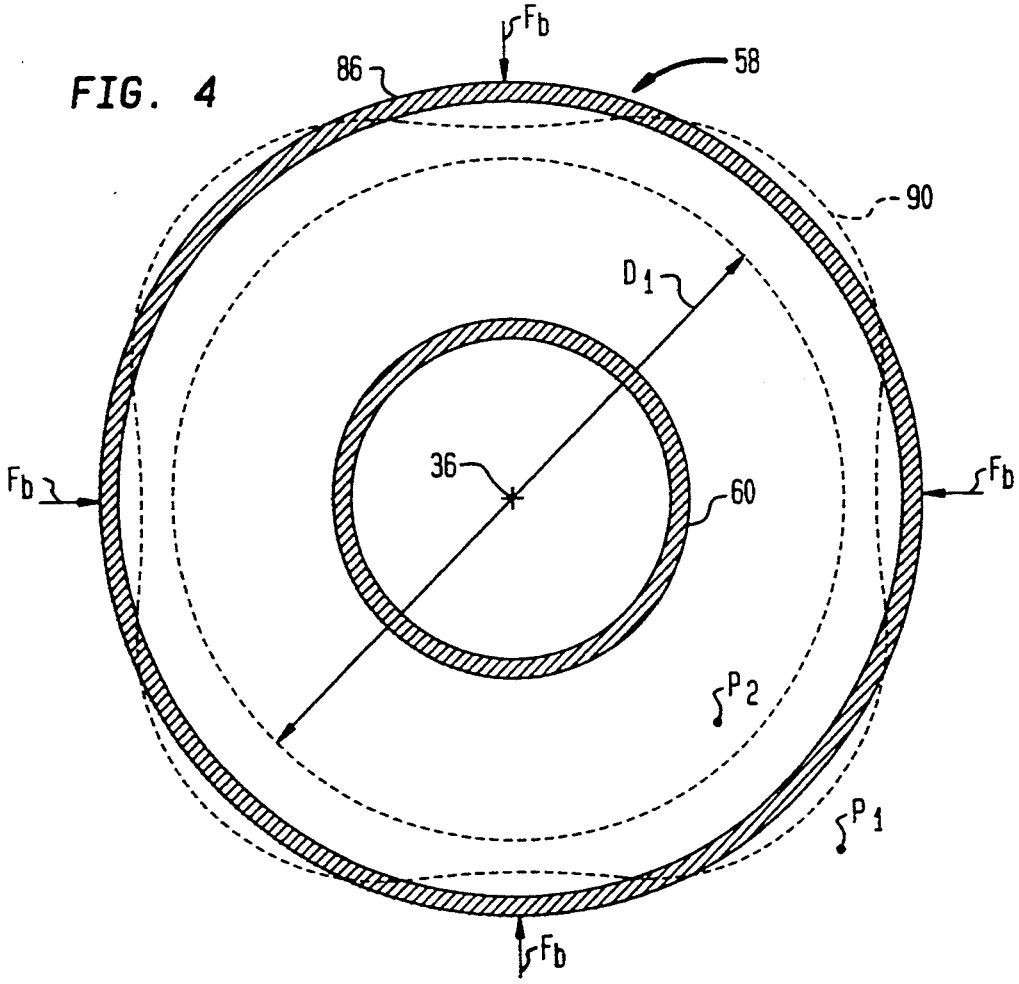
FIG. 4 is a transverse axial view of the combustor illustrated in FIG. 3 taken along line 4—4.

FIG. 4 illustrates a transverse sectional view of the combustor 24 illustrated in FIG. 3 through a radial plane extending through the apex 86. Shown in dashed line and designated 90 is a schematic and exemplary indication of one mode of buckling of the outer liner 58 which might occur from excessive buckling loads $F_b$. By predeterminedly arching the outer liner 58 as above described, the outer liner 58 will experience increased moment of inertia and therefore buckling resistance capability which improves buckling margin for preventing buckling of the outer liner 58 during operation of the engine.

Referring again to FIG. 3, in accordance with another feature of the present invention, the outer liner forward end 58*a* is disposed at a first radius $R_1$ measured relative to the centerline axis 36, the outer liner aft end 58*b* is disposed at a second radius $R_2$ measured relative to the centerline axis 36, and the second radius $R_2$ is preferably different or not equal to the first radius $R_1$. In an embodiment wherein the first radius $R_1$ is equal to about the second radius $R_2$, the outer liner 58 (as defined by the chord 84) forms a nominal cylindrical vessel superimposed by the arched outer liner 58. In an embodiment wherein the second radius $R_2$ is not equal to the first radius $R_1$, the nominal configuration of the outer liner 58 (as defined by the chord 84) is a cone superimposed with the arched outer liner 58. Such a nominal cone configuration provides for increased buckling resistance capability of the outer liner 58 over the nominal cylinder. For the particular double annular dome combustor 24 illustrated in FIG. 3, the first radius $R_1$ is preferably greater than the second radius $R_2$.

In accordance with another feature of the present invention, the outer liner 58 has an axial total length L measured from the forward end 58*a* to the aft end 58*b* which is equal to $L_1$ plus $L_2$, and has a first diameter $D_1$ at the forward end 58*a* which is twice the value of $R_1$, and is shown in FIG. 4. If the ratio of the length L to the first diameter $D_1$, designated $L/D_1$ is too large an effective amount of arching of the outer liner 58, as represented, for example by $H_{max}$, may not be practical for providing an effective amount of buckling resistance capability in a production gas turbine engine. For example, as the $L/D_1$ ratio increases, $H_{max}$ must correspondingly increase to provide effective buckling resistance capability. The limit on the value of $H_{max}$ is reached in part on physical constraints in providing such an arched outer combustor liner in a particular gas turbine engine. It is also limited by combustor aerodynamic concerns including acceptable flow of the airflow 50 over the outer surface of the liner 58, and combustion dynamics inside the combustion zone 62 which affect the cooling effectiveness of the film cooling air 82 and the conventionally known profile and pattern factors of the combustion gases 54. In the preferred embodiment illustrated having the double annular dome 64, an $L/D_1$ ratio of about 0.14 to about 0.2 with the radius $R_a$ of about 8 inches (about 20 cm) were found by analysis to provide an effective amount of buckling resistance solely by utilizing the arched outer liner 58 without unacceptable aerodynamic performance of the airflow 50 or of the combustion gases 54. In this exemplary embodiment $R_1$ is about 19.3 inches (49 cm), $R_2$ is about 19.2 inches (48.8 cm), and L is about 5.4 inches (13.7 cm).

In accordance with another feature of the present invention, the outer and inner liners are mounted at the aft ends 58*b* and 60*b* as above described, and the compressor airflow 50 exerts a pressure force in generally the axial direction on the combustor 24 as represented by the resultant force $F_A$ as illustrated in FIG. 3. The resultant force $F_A$ is simply the difference in pressure of $P_1$ minus $P_2$ times the area of the dome 64. The axial pressure force $F_A$ acting on the dome 64 includes a generally axially directed component $F_c$ which is transmitted through the outer liner 58 to the outer casing 38 parallel to the chord 84. The chord component force $F_c$ transmitted through the outer liner in the aft mounted combustor 24 is a compressire load which, but for, features of the present invention is generally undesirable since it ordinarily tends to decrease buckling resistance capability of a vessel. For example, in a cylindrical vessel subject to compressire loads in the axial direction, buckling resistance capability of the vessel would be decreased since the compressire axial forces are additive in effect to those forces exerted on the outer surface of the vessel due to buckling pressure. In other words, the stresses in the outer liner due to these two forces would be additive.

However, in accordance with the present invention, by utilizing the arched outer combustor liner 58 as above described, the compressire axial chord force $F_c$ transmitted through the arched outer liner 58 is against, or subtracted from, the effect of the radially directed pressure force $F_b$ for increasing the buckling resistance capability of the outer liner 58. In other words, the stresses in the outer liner due to these two forces would be subtractive. Since the outer liner 58 is initially configured convex outwardly, the chord compressire force $F_c$ tends to move the forward end 58*a* closer to the aft end 58*b* which tends to buckle outwardly the outer liner 58. This acts against the radial pressure force $F_b$ which tends to separate the forward end 58*a* from the aft end 58*b*, and tends to buckle inwardly the outer liner 58.

Accordingly, the outer liner 58 may be positioned in the preferred embodiment so that the dome axial force $F_A$ generates an axial compressire chord force $F_c$ through the outer liner 58 to the outer liner aft end 58*b*. In a preferred embodiment, the radius $R_1$ of the forward end 58*a* may be made substantially equal to the radius $R_2$ of the aft end 58*b* so that the chord 84 is positioned generally parallel to the centerline axis 36 for providing a maximum amount of the axial component of compressire force $F_c$ through the outer liner 58. Of course, the directions of the axial forces $F_A$ and $F_c$ are dependent upon the particular configuration and orientation of the combustor 24 including the outer liner 58 and the dome 64, for example. In accordance with the teachings herein, the configuration and positioning of the outer liner 58 may be optimized for maximizing buckling resistance capability by both the preferred arcuate profile of the outer liner 58 and application of relative maximum amounts of the axial component chord force $F_c$ through the outer liner 58 for further increasing buckling resistance of the outer liner 58.

Figure 5:
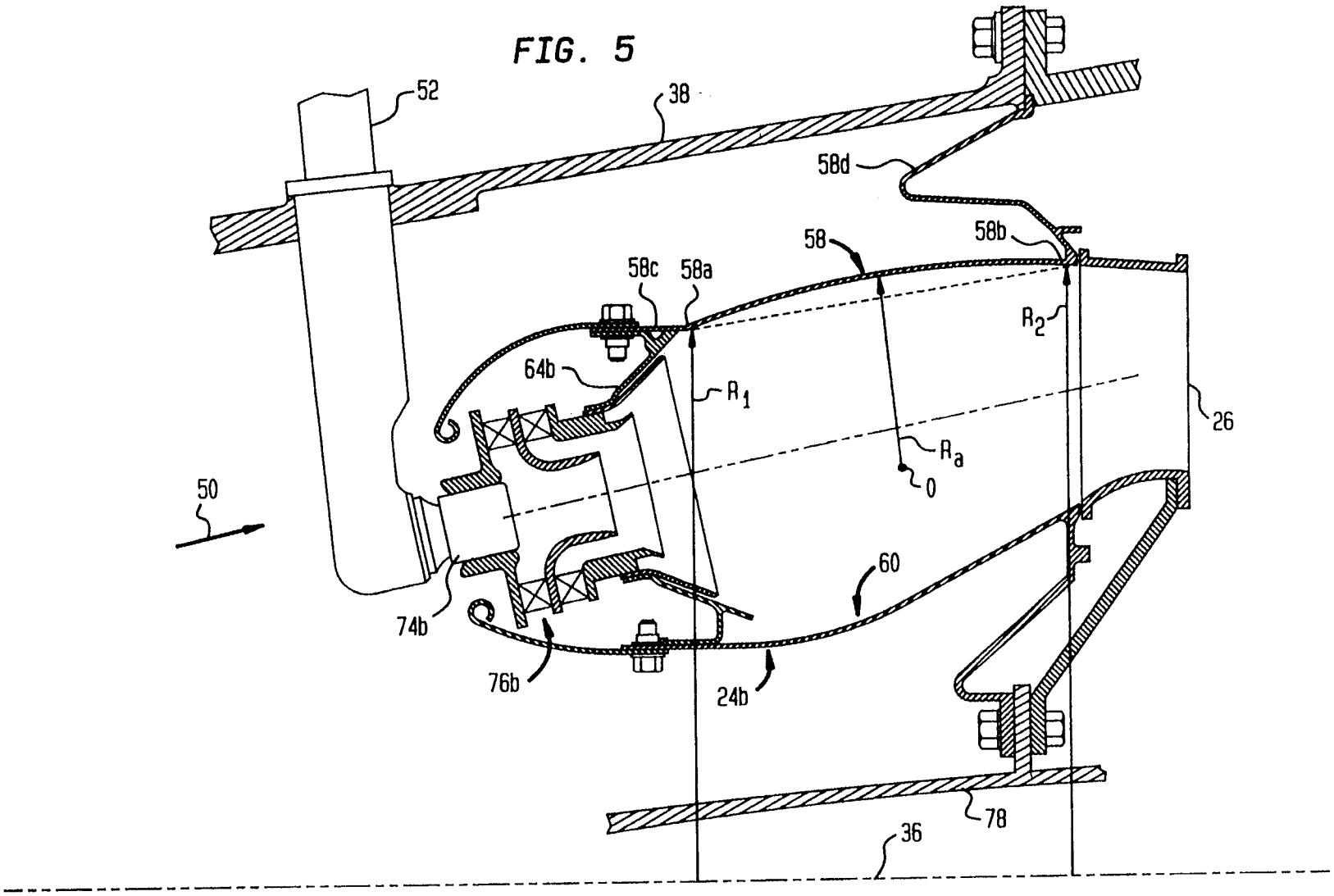
FIG. 5 is a longitudinal sectional view of a combustor in accordance with an alternate embodiment of the present invention.

Illustrated in FIG. 5 is another embodiment of the combustor 24 in accordance with the present invention and designated 24*b*. In this embodiment of the invention, the outer liner 58 is conceptually substantially identical to the outer liner 58 illustrated in the FIG. 2 embodiment except for particular dimensions thereof, including the second radius $R_2$ being greater than the first radius $R_1$. The major difference in the FIG. 5 embodiment of the present invention is the use of a single annular dome designated 64*b* which includes a single row of circumferentially spaced fuel injectors 74*b* and swirlers 76*b* instead of the two annular rows illustrated in FIG. 2. In this embodiment, however, since the effective area of the dome 64*b* is generally less than that of the double annular dome 64 for equal first radii $R_1$, the resultant axial pressure loads acting on the dome 64*b* are also less than those acting on the dome 64 in FIG. 2. Therefore, the increase in buckling resistance capability of the outer liner 58 due to solely the axial pressure load $F_A$ is reduced. The arched outer liner 58, however, nevertheless provides for effective buckling resistance capability of the outer liner 58 which may be further increased, if desired, by increasing the maximum arch height $H_{max}$ as above described.

Accordingly, the improved combustor in accordance with the present invention, provides for a substantial reduction in complexity, weight, and cost of the combustor by utilizing an arched outer combustor liner having a substantially uniform thickness without the need for conventional stiffening rings and cooling nuggets. Conventional combustor liner materials may be used and enjoy the benefits of the present invention. For example, commercially available Hast-X, HS-188, and high-temperature, high-strength nickel-based superalloy may be used, with the nickel superalloy being preferred for obtaining both improved buckling margin as well as significant creep life.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

We claim:

1. A gas turbine combustor having an axial centerline axis, comprising:

(a) an annular outer liner disposed coaxially about said centerline axis and having a forward end and an aft end;

(b) an annular inner liner disposed coaxially about said centerline axis and spaced radially inward from said outer liner to define a combustion zone therebetween and having a forward end and an aft end;

(c) an annular dome fixedly joined to said forward ends of said outer and inner liners having apertures for receiving circumfentially spaced carburetors;

(d) stationary casing means for supporting said inner and outer liners to inner and outer casings, respectively, said stationary casing means being positioned at said outer and inner liner aft ends, wherein compressed airflow provided to said combustor effects an axial force against said dome which is transmitted through said liners to said stationary casing means; and (e) said outer liner having a substantially uniform thickness from said forward to said aft ends and being arcuate in a longitudinal plane from said forward to said aft ends for providing buckling resistance of said outer liner.

2. A combustor according to claim 1 wherein said outer liner has a substantially constant radius of curvature in said longitudinal plane from said forward to said aft ends.

3. A combustor according to claim 1 wherein said outer liner has a straight chord extending from said forward to said aft ends, is convex outwardly relative to said chord, and has an apex of maximum arch height relative to said chord, said apex being disposed substantially equidistantly between said forward and aft ends.

4. A combustor according to claim 1 wherein said outer liner forward end is disposed at a first radius relative to said centerline axis, said outer liner aft end is disposed at a second radius relative to said centerline axis, and said second radius is not equal to said first radius.

5. A combustor according to claim 1 wherein said outer liner forward end is disposed at a first radius relative to said centerline axis, said outer liner aft end is disposed at a second radius relative to said centerline axis, and said first radius is greater than said second radius.

6. A combustor according to claim 1 wherein said outer liner includes a plurality of inclined cooling air holes extending therethrough for providing a cooling air film along an inner surface of said outer liner for cooling said outer liner.

7. A combustor according to claim 1 wherein said outer liner has an axial length from said forward to said aft ends and a diameter at said forward end, and a ratio of said length to said diameter of about 0.14.

8. A combustor according to claim 7 wherein said outer liner has a radius of curvature in said longitudinal plane from said forward to said aft ends of about 8 inches (about 20 cm ).

9. A combustor according to claim 1 wherein said outer liner is positioned so that said dome axial force generates an axial compressive load through said outer liner to said outer liner aft end.

10. A combustor according to claim 9 wherein said outer liner is positioned generally parallel to said centerline axis.

* * * * *